United States Patent [19]

Honda et al.

[11] Patent Number: 4,933,523

[45] Date of Patent: Jun. 12, 1990

[54] PUSH-BUTTON SWITCH

[75] Inventors: Sueaki Honda, Kurayoshi; Mitsuji Hayashi, Nagaokakyo; Takashi Niwa; Akihiko Hayakawa, both of Kyoto; Hideyuki Bingo, Uji, all of Japan

[73] Assignee: Omron Tateisi Electronics Co., Kyoto, Japan

[21] Appl. No.: 277,482

[22] Filed: Nov. 29, 1988

Related U.S. Application Data

[63] Continuation of Ser. No. 47,599, May 11, 1987, abandoned, which is a continuation of Ser. No. 803,961, Dec. 3, 1985, abandoned.

[30] Foreign Application Priority Data

Dec. 5, 1984 [JP] Japan ..... 59-258173

[51] Int. Cl.[5] ..... H01H 3/00

[52] U.S. Cl. ..... 200/526; 200/314

[58] Field of Search ..... 200/153 J, 314, 67 B, 200/302.2, 526

[56] References Cited

U.S. PATENT DOCUMENTS

| | | | |
|---|---|---|---|
| 3,274,354 | 9/1966 | Stevens . | |
| 3,691,333 | 9/1972 | Elliott | 200/153 J |
| 4,268,735 | 5/1981 | Iwakiri | 200/67 B |
| 4,431,879 | 2/1984 | Fujita et al. | 200/374 |
| 4,447,685 | 5/1984 | Ohashi et al. | 200/153 J |

FOREIGN PATENT DOCUMENTS

| | | |
|---|---|---|
| 0077927 | 9/1982 | European Pat. Off. . |
| 0160206 | 3/1985 | European Pat. Off. . |
| 2435116 | 8/1979 | France . |

*Primary Examiner*—Linda J. Sholl

*Attorney, Agent, or Firm*—Wegner & Bretschneider

[57] ABSTRACT

A push-button switch including a switch base which is formed into two divisions each for mounting a switch mechanism thereon, the terminals of one circuit provided within the switch mechanism being molded in insertion in the respective division switch base, whereby the switch base is made smaller in size and simplified in assembly of the push-button switch.

8 Claims, 6 Drawing Sheets

PUSH-BUTTON SWITCH

This application is a continuation of United States application Ser. No. 047,599, filed May 11, 1987, now abandoned, which is a continuation application of Ser. No. 803,961, filed Dec. 3, 1985, now abandoned.

BACKGROUND OF THE INVENTION

The present invention relates to such a pushbutton switch as is used in various types of electric appliances such as audio appliances or the like and more particularly, to a push-button switch, which is capable of the operation characteristics of a stable switch and is rendered smaller in size.

Generally, this type of push-button switch turns on and off the switch mechanism through an operation plunger which operatively cooperates with the depressing operation of the switch.

However, when the switch has been depressed, it is depressed with the operation plunger being inclined, so that the operation plunger comes into local contact against, for example, the housing which slides and guides the operation plunger, thus increasing the frictional force during the depression or causing hooking phenomenon to deteriorate the operation feeling of the switch. In addition, abrasion powder which are caused by the local contact operation are mixed into the switch mechanism to deteriorate the operation characteristics of the switch.

Thus, under the existing conditions, the guide members with respect to the operation plunger increase in number or the guide member is set longer to control the inclination of the operation plunger. As the accommodation space of the housing has these guide members, the entire switches are rendered larger in size.

Also, this type of push button switch is adapted to turn on and off the switch mechanism through the operation plunger which operatively cooperates with the depressing operation of the switch, but restoring springs are normally provided oppositely in the depressing direction with respect t the operation plunger to restore the operation plunger in its original position.

As the electrically conductive terminals of such light emitting elements were located in the vicinity of the restoring springs built-in within the housing, the light-emitting element holders were made of electric insulating material and were disposed between the terminal and the restoring spring. As the light emitting element holders were arranged in construction considering the insulating property, the switches became longer in the axial length and larger in size. Also, as the restoring spring was formed in a ring shape corresponding to the inner diameter of the housing and was built-in, larger accommodating space only for the restoring spring use was required within the housing, so that the switches could not be rendered smaller in size.

SUMMARY OF THE INVENTION

Accordingly, an object of the invention is to provide a push-button switch which is adapted to ensure the stable operation characteristics of the switch, though the switch is smaller in size, even if the switch is depressed.

Another object of the invention is to provide a push-button switch which may be rendered smaller in size with accurate electric insulation property being applied on the restoring springs.

Still another object of the invention is to provide a push-button switch, wherein the operation plunger is not rendered larger in size, also the switch actions are stable even if an alternating mechanism is provided.

A further object of the invention is to provide a push-button switch, wherein the insert molding of the terminal with respect to the switch base may be performed while the switch base which is made longer in the insulation creeping distance between the terminals is made smaller in size.

Still a further object of the invention is to provide a push-button switch, where connection may be made with high strength, even if the connection area of the divided switch base is small.

Another important object of the invention is to provide a push button switch, wherein the switch base is designed not to have play and not to have overload applied while the switch can be made smaller in size, and may be built-in into the housing.

An additional object of the invention is to provide a push button switch, wherein the coil spring is not disengaged unexpectedly during assembly of the switch, with also a portal switch cover is not weakened even if the switch is made smaller in size.

An even further object of the invention is to provide a push-button switch, wherein the switch member is integrally provided as a unit to simplify the incorporation thereof into the housing and to increase the reliability with respect to the switch mechanism.

According to the present invention, there is provided a push-button switch having a guide member and restoring springs for axially guiding the operation plunger alternately provided in the peripheral direction, both the guide member and the restoring spring being disposed a the guiding member of the operation plunger. The guide member makes peripheral-face contact with the housing to direct the guiding operation in the diametral direction and to regulate the inclination of the operation plunger. The restoring springs expand and contract individually with respect to the depression force of the operation plunger to also direct the guiding operation in the diametral direction so as to regulate the inclination of the operation plunger. The operation plunger is stably slid by the joint use of the guiding functions in both directions. Particularly, because the restoring springs are separately disposed along both sides on the inner periphery of the operation plunger, if the restoring spring on one side is strongly depressed, because the operation plunger is depressed at its end, then that spring repulses the operation plunger more strongly. Accurate regulating operation with respect to the end depression is effected to completely remove the local contact operation so that the wellbalanced, superior operation feeling is always provided. Because accurate guiding operation of the operation plunger with respect to the end depression is provided, the guide member is not required to be set long, so that many guide members may be omitted. Thus, space is saved, and the switches may be made smaller in size.

The present invention is provided with a push-button switch wherein the restoring springs with respect to the operation plunger are separately disposed in opposite positions along the periphery, the restoring springs body being separated into two locations so that these separate restoring springs may be formed smaller, thereby providing inner spaces among the opposite portions of the restoring springs. One portion of the switch unit may be interposed with respect to the internal space with the result that the switch efficiently uses the accommodation space within the housing and thus may be made smaller in size. Also, the restoring spring may be individually separated and disposed to improve the electric insulation. In addition, as the restoring spring may be locally disposed smaller, the axial guide length with respect to the restoring spring may be made longer, so that a stable switch depressing operation may be provided. Also, the wide accommodation space may be provided between the opposite portions of the restoring springs, the contact corresponding portion of the terminal may be formed between the corresponding portions so that the mutual terminals may be provided in the sufficient length suitable for contact, also may be set in the optimum contact pressure and in the terminal shape.

The present invention is provided with a push-button switch having an opening window as an alternating mechanism formed on the operation member of the operation plunger which turns on and off the switch mechanism. Therefore, the operation member with the opening window serves both the operating function and alternating function of the switch, thus obviating the need for separate vertical members to provide this opening window. Therefore, the diametral, axial space saving with respect to the mutual switch parts may correspondingly be provided, the construction may be simplified and the switches may be rendered smaller in size. In addition, since the operation member and the opening window are formed along the same peripheral portion of the operation plunger, the on and off operation of the switch mechanism by the operation member and the lock and unlock operation of the alternating mechanism by the opening window are operated in synchronous relation. Accordingly, the correct alternate operation corresponding to the switch mechanism is provided. Even if the operation plunger is inclined when the switch is pushed, the operation characteristics of the switch which normally operates in synchronous relation is stable.

The present invention is provided with a pushbutton switch wherein the switch base, which supports the switch mechanism thereon, is divided, the switch base is made smaller in size and the switch base manufacturing is simplified in accordance with the division construction. The switch base is divided into two during the manufacturing operation and may be integrally built-in during assembly, thus allowing the complicated unevenly formed faces, which should be formed on the base outer surfaces, to be divided into two in the manufacturing operation of the switch base. Accordingly, the two-piece base is reduced in the unevenly formed faces and the direction of the unevenly formed faces becomes constant in direction so that the metallic-mold construction may be simplified to allow easier insertion of the terminal. In this manner, the divided construction of the switch base allows the switch base, with terminals being efficiently combined, to be manufactured, and the insulation creeping distance to be set sufficiently long though the size is small, ensuring higher safety and stable switch function. Also, as the pressure-inserting operations of the terminals become unnecessary, the assembling operation is simplified and the cost may be reduced.

The present invention is provided with a pushbutton switch, wherein during connection of the halves of the switch base, the rising connection face is provided on of the halves of the face the division switch base. The push-button switch has two connection faces, i.e., one connection face to be provided with the section area of the switch base thickness, and a second rising connection face to be erected on the base. As the connection face of the base thickness is comparatively long in the horizontal direction, higher connection strength is provided with respect to the external force of the horizontal direction, while the rising connection face exhibits higher connection strength with respect to the external force of the vertical direction. Accordingly, the connection is performed with higher connection strength between the halves of the switch base, the higher connection strength being equivalent to the large area, wherein the base diameter length of the horizontal direction and the rising length of the vertical direction are engaged with each of the lengthwise and breadthwise. In particular, as the rising connection face is different in direction: than the base thickness connection face, the connection strength of the whole connection face may be properly increased efficiently even if the division face is of partial small area. Therefore, the switch base becomes small, but sturdy enough not to be unexpectedly broken even if the switch base is subject to a strong external force.

The present invention is provided with a pushbutton switch wherein the top face of the switch base has an elevated portion which exhibits the stable contact supporting operation with respect to the inner peripheral face of the housing, and an engagement pawl corresponding to the engagement opening of the housing. The elevated portion of the switch base is in axially long contact against the inner peripheral face of the housing, and the outer peripheral face of the switch base is in contact in the peripheral direction against the inner peripheral face of the housing so that the switch base is stably accommodated. Thus, the switch base may be accommodated and retained without any play within the housing while the thickness of the switch base is reduced to render the entire switch smaller in size. In addition, because the elevated portion on the free end side can be elastically deformed when the switch base is pressed and accommodated into the housing, it may be smoothly pressed and accommodated into the housing. The elevated portion can also absorb the excessive load during the depressing operation if the gap corresponding to a engagement pawl does not exist between the housing and switch base. Also, as the engagement pawl is formed on the elevated portion, the opening position of the engagement opening corresponding to the engagement pawl is located above the switch base. The thin portion of the housing corresponding under the engagement opening as at present is removed to help prevent the failure of the wall face of the housing and the failure of the engagement pawl.

The present invention is provided with a pushbutton switch having a regulating member, which also serves as a reinforcing member, provided between the leg portions of the portal switch cover to regulate the oscillation spring. The regulating member is vertically disposed on the switch cover and comes into contact with the coil spring mounted on the switch base to regulate the oscillation of the coil spring. Thus, if the switch base and the switch cover are temporarily engaged with each other integrally as a switch unit before incorporation into the housing, the coil spring is stably supported. Thus, the temporary engagement is provided to prevent the disengagement of the switch components. Therefore, as the incorporating operation is effected as a single unit for each of the temporarily engaged switch units, the handling or controlling of the switch components is simplified. Efficient insertion into the housing may be effected without disengagement of the switch components such as the coil spring or the movable members related to it.

In addition, as the regulating member is provided between the portal leg portions, which are easy to break, of the switch cover as a reinforcing member, the switch becomes sturdy enough even if the switch cover is portal in shape, thus positively improving the assembly efficiency and reliability of the switch.

The present invention is provided with a pushbutton switch, wherein the switch base and the switch cover are adapted to be temporarily engaged with each other. The overall assembling of the switch portion and the entire switches are thereby simplified, and the switch base, which has the switch mechanism mounted thereon, and its switch cover may be temporarily engaged integrally as a switch unit. The switch units may be handled as a single unit without any touch of minute switch components. The handling or controlling operations with respect to the switch components becomes simplified. The efficient insertion of the switch unit into the housing may be effected without any disengagement of the switch components or requirement of the skill. In addition, one-time washing operation of each switch unit may be effected to prevent hand dirt or the like from being applied upon the switch components. Therefore, the switch becomes higher in quality to improve the reliability and looks of the switch mechanism.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1B:
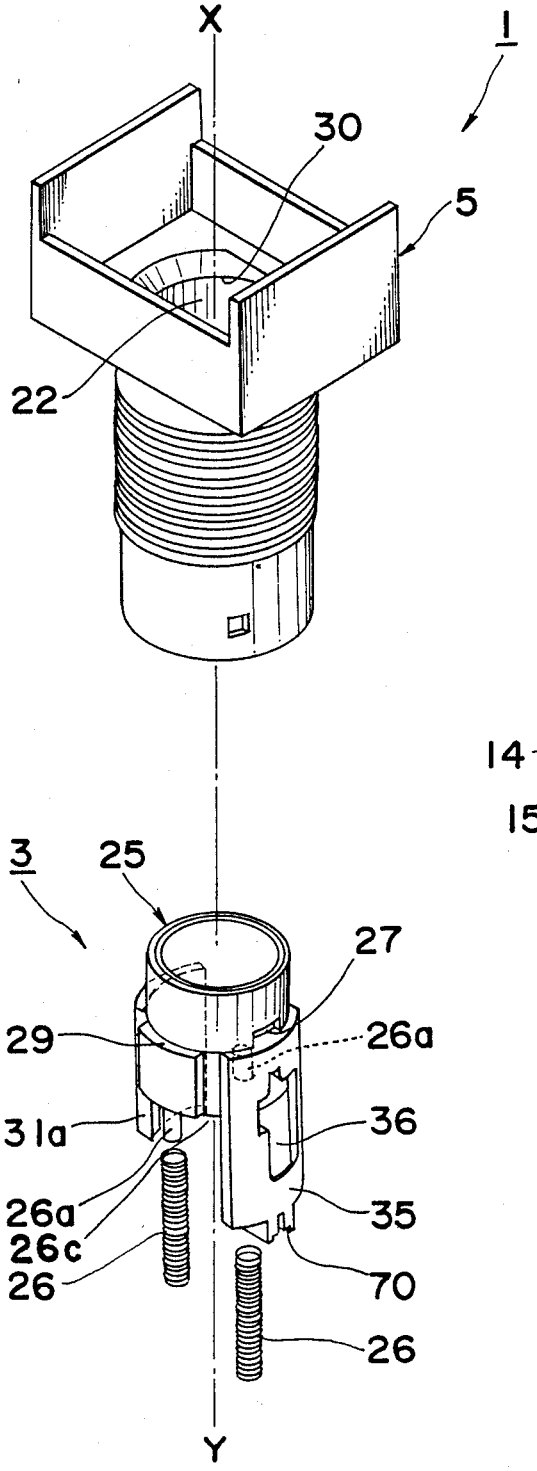
FIGS. 1*a–c* are exploded perspective views of an illumination push-button switch in accordance with one embodiment of the present invention.

Before the description of the present invention proceeds, it is to be noted that like parts are designated by like reference numerals throughout the accompanying drawings.

Figure 1A:
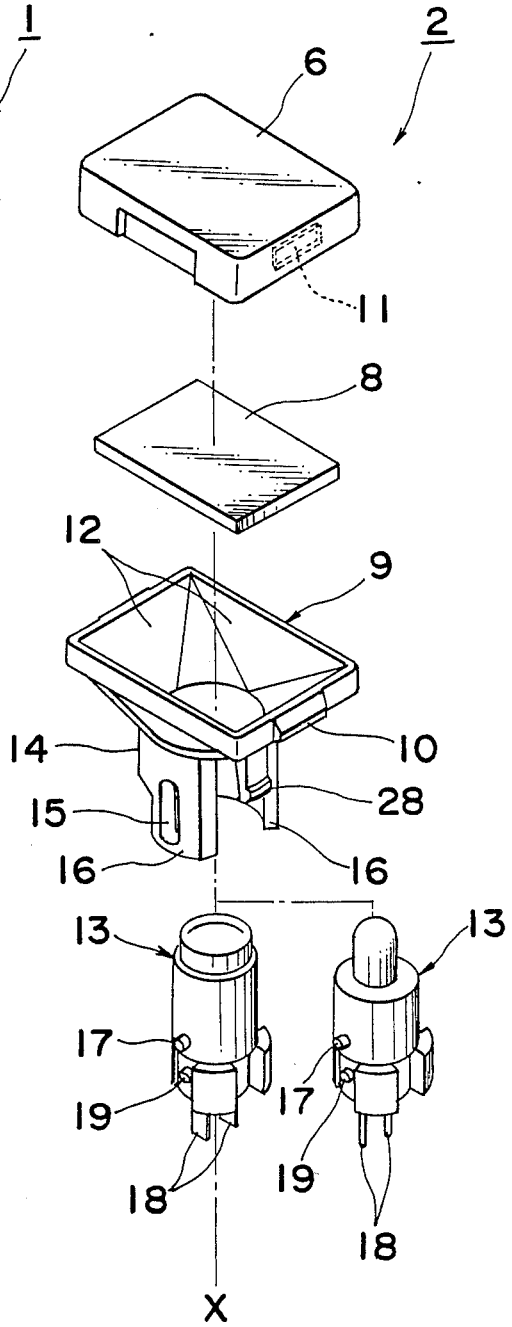
Figure 1C:
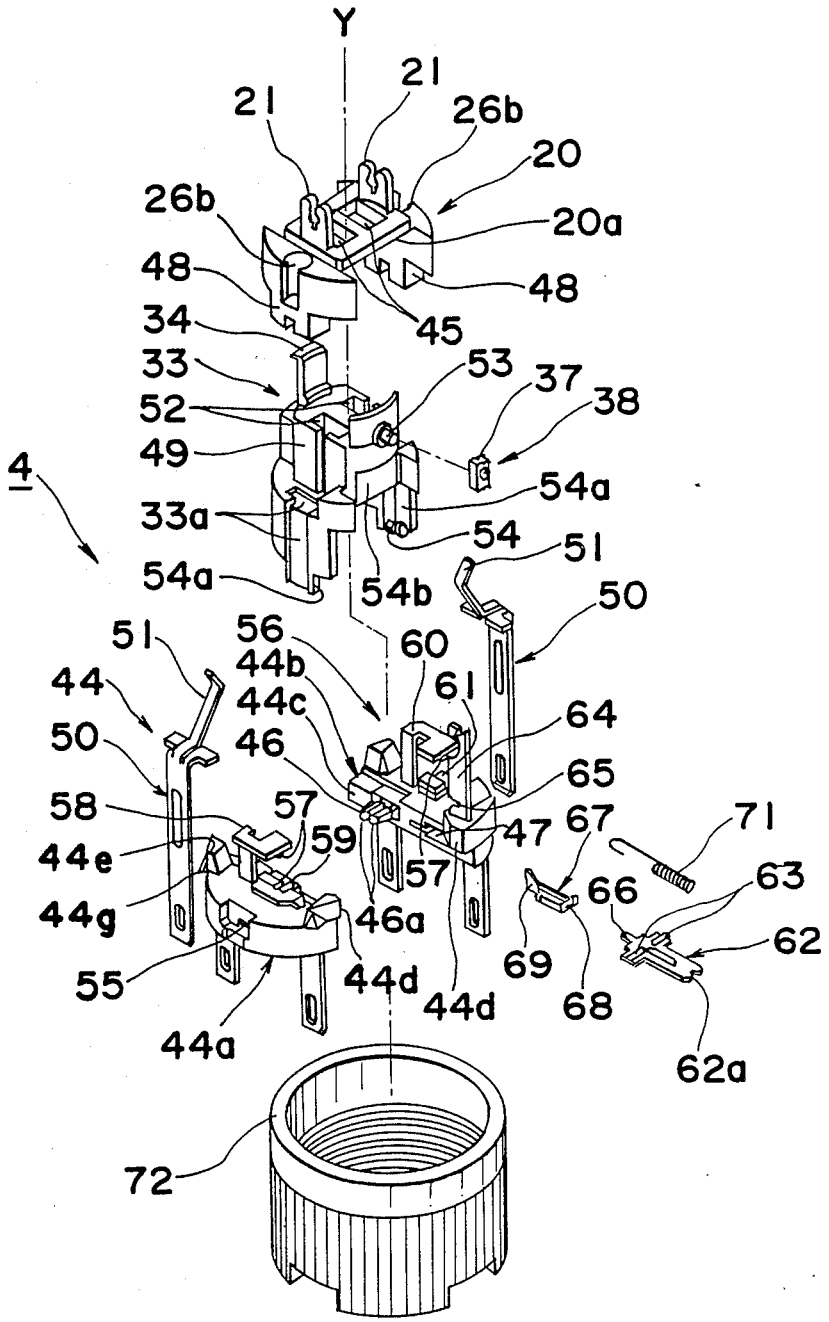
Figure 2:
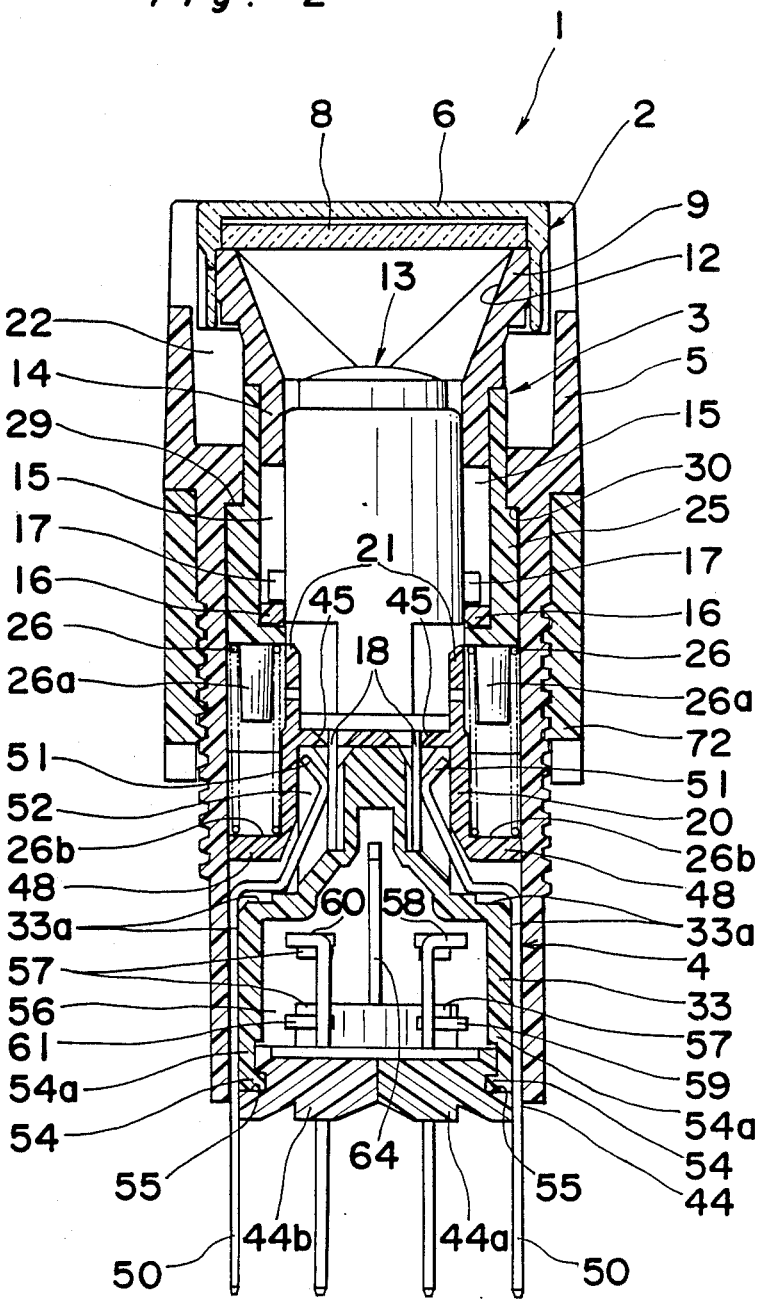
FIG. 2 is a longitudinal sectional side view of the illumination push-button switch.
Figure 3:
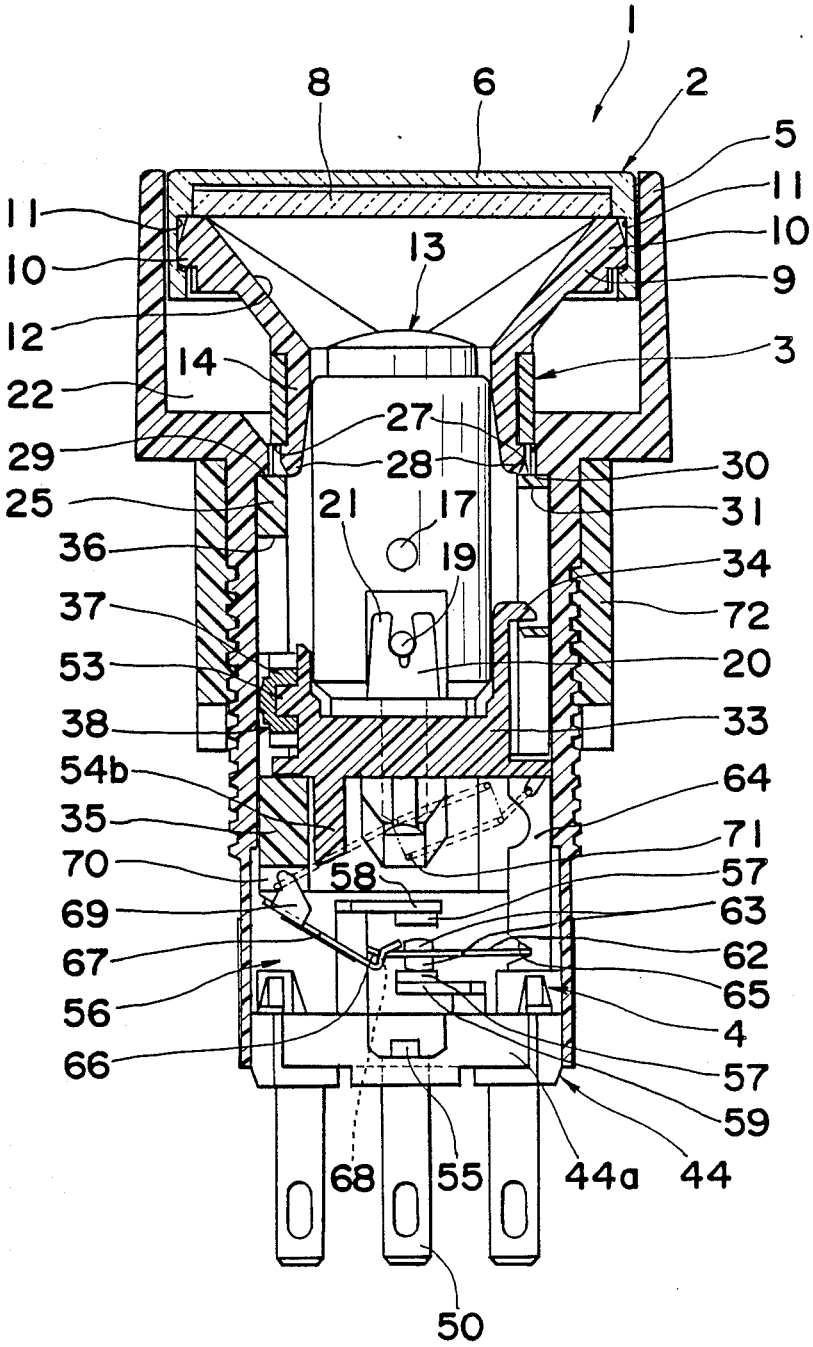
FIG. 3 is a longitudinal sectional front-face view of the illumination push-button switch.

Referring now to the drawings, there is shown in FIGS. 1 through 3 an illumination push-button switch. The illumination push-button switch 1 is chiefly composed of an illumination unit 2, an operation unit 3, a switch unit 4, and a housing 5 which accommodates and retains these units.

The illumination unit 2 is provided as an illuminating member which serves as a push-button portion. A diffusion plate (reflection plate) 8 is internally disposed within a box-shaped collar cap 6 which is colored in optional colors such as red, yellow, green, etc. and is open in the bottom face. The diffusion plate is engaged on the top face of the reflection plunger 9 corresponding to the under portion. The reflection plunger 9 is provided in its top face with rectangular open face corresponding to the bottom face open portion of the color cap 6. The engagement convex portion 10 projected from on portion of the outer peripheral side face is correspondingly engaged with the engagement concave portion 11 of the color cap 6 to serve as one unit.

And bell-shaped reflection faces 12 whose peripheral faces are contracted into a conical shape downwardly from the top face so that the light may be upwardly guided. A cylindrical retaining portion 14 for retaining a light emitting element 13 such as a lamp, light-emitting diode or the like in the lower central portion. Vertical members each having a long hole 15 opened by a depressing stroke length along the depressing direction on its side are vertically disposed in the cylindrical retaining portion 14. Upper projections 17 which are projected from both sides on the side face of the light emitting element 13 are respectively engaged into the long holes 15. Thus, the light emitting element 13 oppositely faces in the light emitting portion of the upper portion the top face side of the reflection plunger 9. The external terminals 18 of the lower portion of the light emitting element are mounted, being exposed under the reflection plunger 9.

Also, the lower projections 19 projected from both sides on the side face of the light emitting element 13 are engaged, for preventing the draw out, with the engagement pawls 21 of the light emitting element holder 20 to be described later. Through this fixing operation, the reflection plunger 9 is allowed to be depressed by the depressing stroke length, independent of the light emitting element 13. In addition, the reflection plunger 9 is engaged detachably from the upper open face 22 and is guided in sliding contact against the inner face of the housing 5 to ensure the stable depressing operation. Pull the reflection plunger 9 externally from the upper-side open face of the housing 5 and the light emitting element is simultaneously taken out externally through disengagement between the lower projection 19 and the engagement pawl 21, thus allowing the light emitting element 13 to be easily replaced.

The above-described diffusion plate 8 uniformly scatters the lights from the light emitting element 13 and reflects them, and has desired display letters, numerals or the like printed on the surface.

And an operation unit 3 to be described later is disposed within the housing 5 under the above-described illumination light unit 2.

The operation unit 3 is composed of an operation plunger 25 and restoring springs 26 which urge the operation plunger upwardly. The operation plunger 25 is formed into a step cylindrical unit, which has a small-diameter portion 25*a* on its upper side and has a large-diameter portion 25*b* on its lower side. The engagement pawls 28 of the reflection plunger 9 are respectively engaged with the opening portions 27 opened in both side faces of the small diameter portion so that both of the plungers 9 and 25 are integrally coupled to each other.

The above-described restoring spring 26 is set so that a pair of right and left small-diameter coil springs may be disposed. Thus, the inner space 26*c* is formed between the opposite portions of a pair of right and left restoring springs 26. A top end portion of the switch unit 4 is partially interposed from below with respect to this inner space 26c so that the axial length of the switch is shortened to make the entire switch shorter in barrel.

And the top end portions of the restoring springs 26 are respectively engaged with a pair of right and left spring engagement projections 26a which are vertically disposed oppositely in the diametral direction of the large-diameter lower portion to engage the top ends of the restoring springs 26 with the lower ends of the restoring springs being engaged onto the light emitting element holder 20 to be described later. And the operation plunger 25 is normally in an upwardly moving position because of the upwardly urging force of the restoring springs 26 so that the outer peripheral stage portion 29 of the operation plunger 25 is engaged with the inner peripheral stage portion 30 of the housing 5 to prevent the outer peripheral stage portion from being drawn out.

Furthermore, in the large diameter portion 25b, a vertical member 31a as a guide member with respect to the operation plunger 25, and an operation member 35 to be described later are vertically disposed in the opposite positions in the diametral direction grasping the above-described restoring spring 26 in the peripheral direction. The operation plunger 25 is smoothly advanced and retreated by both members 31a and 35 and the above-described pair of right and left restoring springs 26.

In this case, the sides of both members 31a and 35 function as a peripheral-face contact operation during the advancing and retreating operations of the operation plunger 25 with the outer peripheral faces being correspondingly in contact against the inner peripheral faces of the housing 5 to regulate the inclination of the operation plunger 25 with respect to the diametral direction. Also, the sides of a pair of right and left restoring springs 26 function as the guiding operation with respect to the individually corresponding axial direction with respect to the depressing force of the operation plunger. Especially when the switch has been end-depressed, the restoring spring 26 on the side where the stronger depression is performed is strongly repulsed to regulate the end depression. Accordingly, the operation plunger 25 smoothly slides through the multiplication effect of both the members 31a and 35 and the restoring springs 26 to ensure the stable operation characteristics and operation feel of the switches.

In addition, the large diameter portion has a long hole 31 opened for the depression stroke length along the depression direction. The operation plunger 25 is regulated in the depression stroke through the corresponding engagement between the long hole 31 and the engagement projection 34 of the switch cover 33 to be described later.

Also, the large diameter portion has an operation member 35 vertically disposed to turn o and off the switch at the lower end during the depressing operation.

The operation member 35 is provided with an opening window 36 which is shaped as an inverted L and is largely opened in the longitudinal length. The alternate mechanism 38 is composed of the window 36 and a cam 37 which is guidingly regulated for the free rotation by the window The operation plunger 25 is regulated in the depression lock position and the depression lock releasing position by the alternate mechanism 38.

The operating function of the switch and the opening window 36 as the alternate mechanism are efficiently provided through the formation of the opening window 36 in the operation member 35 so that the operation plunger 25 is made smaller in size. Also, even if the operation plunger 25 is tiltingly depressed in accordance with the end depression of the switch, the operating member 35 and the opening window 36 normally operate in synchronous relation, with the operating member 35 and the opening window 36 being provided in the same peripheral position, to correspondingly operate the switch mechanism and the alternate mechanism correctly.

The alternate mechanism 38 is composed of the above-described opening window 36 and a small piece of cam disposed within the opening window 36. The opening window 36 has the top-face central portion within the window 36 notched further into a concave portion. One angular portion in contact against the top face of the notched concave portion 39 is provided in a first top-face angular portion 40 formed into a circular arc shape. The other angular portion is provided in a second top face angular portion 41 formed into a slightly higher position. The above-described cam 37 is rotatingly regulated by each angular portion 40, 41 and 42, the intermediate angular portion 42 of the lower L-shaped intermediate portion is opposite to the first top-face angular portion 40.

The above-described cam 37 has the central portions on the sides of both the rectangular shorter sides described respectively in the V-shaped cam groove 43 for the corresponding engagement use with the above-described angular portions. The cam 37 has the inner-face side of the central portion pivoted for the free rotation on the fixed projection of the switch cover to be described later.

Figure 4:
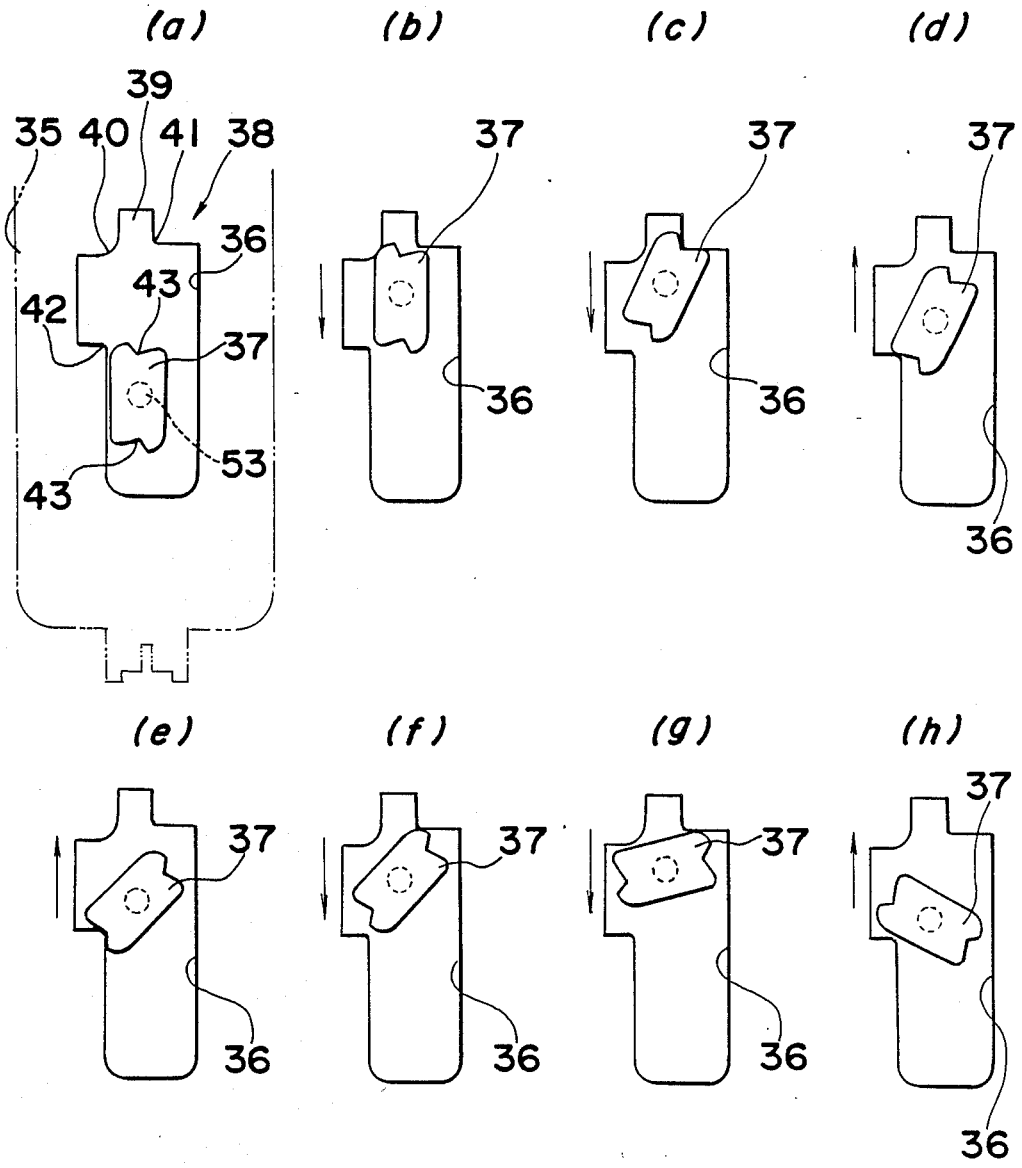
FIGS. 4*a–h* shows views for illustrating the alternate mechanism.

Then, the operating condition of the alternate mechanism 38 will be described with reference to FIGS. 4(*a*) through 4(*h*). Normally, as shown in FIG. 4(*a*), the cam 37 is longitudinally long and is rotatably regulated along the opening side face of the opening window 36. When the illumination unit 2 is depressed, the opening window 36, opened by the plunger, together with the operation plunger 25 moves downwardly. As shown in FIGS. 4(*b*) and 4(*c*), the first top face angular portion 40 comes into contact against the top-face end portion of the cam 37 to tilt the cam 37 so that the cam groove is correspondingly engaged with the second top-face angular portion 41 to regulate the downward motion of the operation plunger 25.

When the depressing force is released, the opening window 36 integral with the operation plunger 25 performs its upward motion slightly as shown in FIGS. 4(*d*) and 4(*e*) to correspondingly engage the intermediate angular portion 42 with the cam groove 43 on the lower side thereby locking the depressed condition of the operation plunger 25.

When the depressing operation is performed again, the second top-face angular portion 41 comes into contact onto the top face of the cam 37 through the downward motion of the opening window 36 as shown in FIG. 4(*f*) to tilt the cam 37 so that the operation plunger 25 is regulatingly depressed in the horizontal condition of the cam 37 as shown in FIG. 4(*g*). Then, when the depressing force is released, the cam 37 is raised in its side face by the intermediate angular portion 42 through the restoring operation (upward motion) of the opening window 36 as shown in FIG. 4(*h*), is half-rotated and is restored to its original condition again in FIG. 4(*a*).

The switch unit 4 is composed of a light emitting element holder 20, a switch cover 33, and a switch base 44. The light emitting element holder 20 is provided in its top-face central portion with insertion holes 45 into which the external terminals 18 of the light emitting element are inserted, and is in its both sides of the top face with the projected engagement pawls 21, which engage the lower projections 19 of the light emitting element through a given retaining force to prevent the lower projections from being drawn out. And small concaved spring engagement grooves **26*b* which sink the restoring springs 26 and accommodate, support them are respectively formed in both the outer positions of both the engagement pawls 21. The lower portions of the above-described restoring springs 26 are respectively inserted into the spring engagement grooves 26*b* and are supportingly guided. The small restoring springs 26 are stably and elastically engaged between the above-described spring engagement projections 26*a* and the spring engagement grooves 26*b***.

Also, the terminal contact guiding faces **20*a* are formed on both sides of the lower face. The guiding faces 20*a* function to depress the top-end contact members 51 of the light emitting terminal 50 to be described later against the above-described outer elements 18** to force them to come into contact against them.

In addition, a pair of support projections 48 are projected in the diametral direction on both sides of the holder 20. The support projections 48 are supported on the switch cover 33 to be described later.

The above-described switch cover 33 has the support projections 48 of the above-described holder 20 guided supportingly on the support guiding faces 49 formed on both side faces of the upper portion. In addition, light emitting terminals 50 are engaged into the terminal engagement grooves **33*a* formed on the side portion of the switch cover 33. The leaf spring shaped upper-end contact members 51, which are bent in the top ends of the light emitting terminals 50, are disposed in the insertion space portions 52, into which the light emitting element external terminals 18 are inserted, within the switch cover 33 so that the top-end contact members may be correspondingly brought into contact into the insertion space portions 52**.

As the insertion space portions 52 are provided with respect to the above-described inner spaces **26*c* which have wide accommodation spaces, the top-end contact members 51 of the light emitting terminals 50 which are inserted into the insertion space portions 52** may be disposed in a shape suitable between the terminals, setting to the sufficient, corresponding contact length.

And an engagement projection 34, which is engaged into the long hole 31 of the operation plunger 25, is projected from the external peripheral face; also a fixed projection 53 which supports the cam 37 as the alternate mechanism 38 is projected from the external peripheral face on the side opposite to the engagement projection.

It is to be noted that a lower engagement projection 54 is used to be integrally coupled to the switch base to be described later.

In addition, vertical members **54*a* as the portal coupling leg portions are respectively disposed vertically on both sides of the switch cover 33. Regulating members 54*b* which serve as reinforcing members to regulate the oscillation of the coil spring in contact with the coil spring of the switch mechanism to be described later are vertically disposed between these vertical members 54*a*. The regulating members 54*b* reinforce the vertical members 54*a* on both sides to efficiently improve the strength. And the lower engagement projections 54 which are used to integrally couple to the switch base 44 to be described later for temporary assembly are projected from the lower-end inner face side of these vertical members 54*a***.

The above-described switch base 44 has each divided switch base **44*a* and 44*b* combined together to form a disc shape, the switch bases 44*a* and 44*b* being divided into two members and shaped into a half moon. To manufacture these divided switch bases 44*a* and 44*b*, each terminal of the switch mechanism of one circuit to be described later is integrally molded in insertion during the resin molding in a metallic mold, so that the efficient engagement with respect to the switch base 44** is performed.

It is to be noted that these bases **44*a* and 44*b*** are separately manufactured to simplify the manufacturing operation with respect to the metallic mold, thus allowing the insertion-molding to be performed.

And these divided switch bases **44*a* and 44*b* have on the mutual connection opposite faces a pair of engagement projection 46 and engagement concave 47, which are adapted to be engaged with each other. In addition, band-shaped convexes 46*a* along the projection direction are provided around the engagement projection 46. Ultrasonic wave welding is performed with the engagement projection 46 being engaged into its opposite engagement concave 47, so that the convex 46*a* is meltingly adhered to the inner face of the engagement concave 47 to integrate both divided switch bases 44*a* and 44*b*** through the ultrasonic wave welding operation.

Furthermore, new rising connection faces **44*d* which are elevated upwardly from the connection face 44*c* of the adjacent base thickness and are used for connection of the divided faces. The ultrasonic wave welding operation is performed with the mutual rising connection faces 44*d* being connected with each other. The combining performance is efficiently improved by the mutual bonding function between the connection face 44*c* having the sectional area of the above-described base thickness and these rising connection faces 44*d*, thus resulting in sturdy switch base 44, which is not divided by external forces. Engagement concaves 55 are respectively notched on both sides of the side face of the switch base 44 integrated as described hereinabove. The lower engagement projections 54 of the above-described switch cover 33 are respectively engaged into these engagement concaves 55 for integral coupling operation. The switch base 44 is integrated with the switch cover 33 to simplify the handling operation as the switch and to extremely simplify the accommodating operation with respect to the housing 5**.

In this case, the switch base 44 is adapted to be inwardly depressed from the lower-end open face of the housing 5 to be accommodated. Several elevated connection faces **44*e*, which are to be connected with the inner peripheral face of the housing 5, are erected in the peripheral direction on the top face of the switch base 44. The stable accommodating conditions are provided with respect to the housing 5 by the multiplication effect of the connection supporting operation with respect to the axial direction by the elevated connection faces 44*e* and the connection supporting operation of the peripheral direction by the external peripheral face of the switch base 44. Therefore, the reduced thickness of the switch base 44** may be set to make the switch smaller in size.

In addition, engagement pawls 44g which are correspondingly engaged with the engagement openings 44f of the housing 5 are respectively projected from the top ends of these rising connection faces 44e. Thus, the switch base 44 is secured to the housing 5 not to be drawn out by the engagement function.

It is to be noted that the smoother accommodation is performed without any application of the excessive load upon the mutual connection members, because the entire rising connection face 44e is elastically deformed even if a gap corresponding to the engagement pawl 44g is not provided between the switch base 44 and the housing 5.

And the switch mechanism 56 of the two-circuit bi-disconnection type is mounted on the same plane of the top face of the above-described switch base 44.

Figure 5:
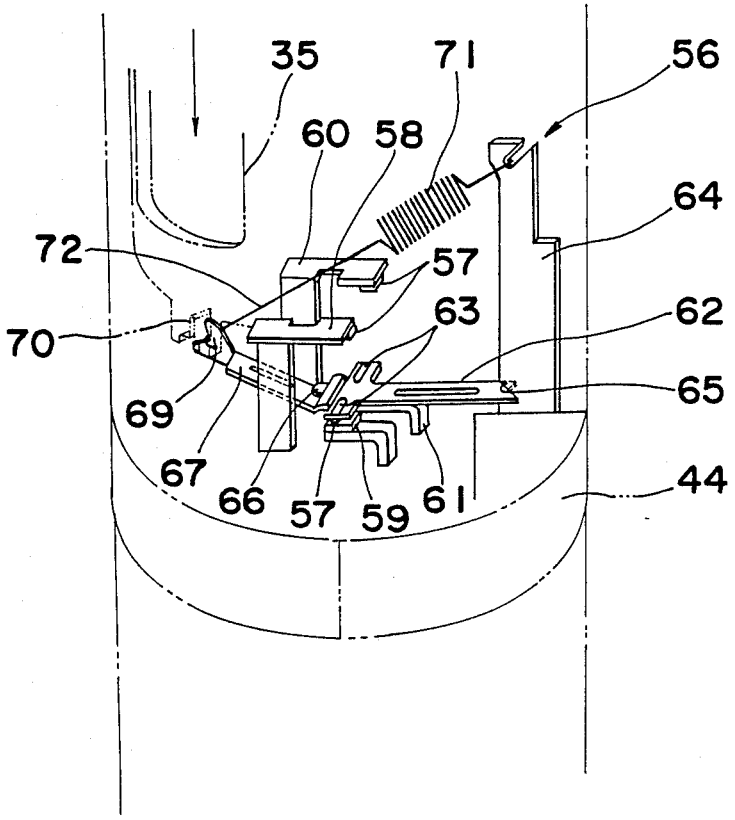
FIG. 5 is an essential-portion perspective view of the switch mechanism.

As shown even in FIG. 5, in the switch mechanism 56, a first top terminal 58 and a first lower terminal 59 with contact members 57 being oppositely disposed up and down, a second top terminal 60 and a second lower terminal 61 with contact members 57 being oppositely disposed up and down in parallel to these terminals are molded in insertion and are planted on the switch base 44. A first movable member 62 broad in width which comes into contact commonly in the horizontal direction is disposed between these upper and lower opposite faces. The first movable member 62 has the contact members 63 disposed in parallel, which correspondingly comes into contact against the contact member 57 of each terminal of both the upper and lower portions. The first movable member 62 with the V-groove 62a at its one end being engaged with the notch 65 of the planted member 64 erected on the switch base 44 has the engagement projection 66 at the other end engaged into an engagement hole 68 formed into one end of a second movable member 67, the other end of the second movable member 67 engaged with the lower end of the above-described operation member 35. An erected member 69 which is partially bent and erected is provided on the other end of the second movable member 67. The erected member 69 is engaged with the longitudinal groove 70 formed in the lower end of the operation member 35 and is regulated in its upward motion.

Also, one end of the coil spring 71 is engaged with the erected member 69, the other end thereof is engaged with the upper portion of the planted member 64. The lower end of the above-described regulating member 54b for regulating the oscillation of the coil spring 71 is in contact against the intermediate portion to perform the positional regulation with respect to the movable members 62 and 67 through the coil spring 71 so that the temporary assembly may be performed in accordance with this positional regulation.

And through the feeding operation of the tensile function of the spring 71, the first movable member 62 urges the other side downwardly with the side of the V groove 62a as a support point, also the second movable member 67 urges the other side downwardly in its inclined condition with the lower end of the operation member 35 as a support point. The condition is normally off with the first movable member 62 being in contact against the first and second lower terminals 59 and 61.

And the upper side of the second movable member 67 in the inclined condition is downwardly moved through the depressing operation of the operation member 35. When the second movable member 67 has exceeded the horizontal straight-line condition with respect to the first movable member 62, the connecting portion of both movable members 62 and 67 upwardly moves to change over the switch into the ON operation.

It is to be noted that in the depression locking condition of the operation plunger 25 by the above-described alternate mechanism 38, the switch mechanism 56 is set into the ON condition, also the switch mechanism 56 is set into the OFF condition through the restoring operation of the operation plunger 25.

Also, the above-described operation unit 3 and the switch unit 4 are inserted from the lower face opening portion of the housing 5 for the mounting operation. In the drawing, a clamping nut 72 for use in the wall-face mounting is screwed on the outer peripheral face of the housing.

In the illumination push-button switch of such construction as described hereinabove, the operation member 35 of the operation plunger 25 together with the reflection plunger 9 is downwardly moved in accordance with the depressing force through the depression of the color cap 6 face of the illumination unit 2 with fingers to downwardly depress the second movable member 67. Through the operative cooperation of it, the first movable member 62 is upwardly moved in the contact side with the tensile force of the coil spring 71.

Thus, the conduction is performed between the first and second upper terminals 58 and 60 through the first movable member 62 to effect the ON operation.

The light emitting element 13 emits the light by such a depression input signal as described hereinabove, and is illuminated. Also, the depression input signal is inputted into a preset given electric appliance.

It is to be noted that the ON condition is locked by the alternate mechanism 38 and is retained until the lock is released.

And the lock of the alternate mechanism 38 is released by the depressing operation of the illumination unit 2 again. Thus, the illumination unit 2 and the switch mechanism 38 are restored to the respective original positions so that the condition may be changed over to the OFF condition.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A push-button switch, comprising: a switch mechanism;

a switch base for supporting said switch mechanism;

a switch cover mounted on said base and enclosing said switch mechanism, said switch cover having a cam mounted on the exterior thereof;

a reciprocating plunger having an operating member, a lower end of said operating member engaging said switch mechanism to turn the switch on and off, said operating member having an opening formed therein for cooperation with said cam;

a push button attached to said reciprocating plunger so that when said push button is depressed, the reciprocating plunger is reciprocated so that said operating member acts on the switch mechanism;

a housing for sealingly enclosing said switch mechanism, switch base, switch cover, and reciprocating plunger;

wherein said cam cooperates with said opening so that said cam locks the reciprocating plunger in either a first position, in which the switch mechanism is turned off, or a second position, in which the switch mechanism is turned on.

2. The push-button switch of claim 1, wherein an opening is formed on the housing and a pawl is formed on an elevated portion which extends above the switch base such that the housing and the switch base are coupled together by the engagement of the pawl and the opening.

3. The push-button switch of claim 1 further comprising:

a pair of springs biased against the reciprocating plunger for returning the reciprocating plunger from the second position to the first position.

4. The push-button switch of claim 1 wherein the switch base is formed from a first part and a second part, with each part having a projection for inserting into the other part to thereby unite the two parts, and wherein the first part supports two terminals of a first type and the second part supports two terminals of a second type such that each terminal of the first type is associated with a terminal of the second type to thereby form two separate switch mechanisms.

5. The push-button switch of claim 1, wherein said switch mechanism comprises at least one fixed lower contact, at least one fixed upper contact, a movable member movable so that it contacts either said fixed lower or upper contact, an erected member, one end of which is connected to said movable member and another end of which engages said operating member, and a biasing spring attached to said erected member so as to bias said movable member against the fixed lower contact, and wherein said switch cover further comprises a regulating member which contacts said biasing spring in order to hold the biasing spring in place during assembly of the switch.

6. The push-button switch of claim 1, further comprising a light emitting element holder attached on top of said switch cover and a light emitting element disposed within said light emitting element holder, wherein said switch over has two terminal engagement grooves located on opposing outer surfaces thereof and said switch further comprises two light emitting terminals for engaging terminals of said light emitting element, said light emitting terminals being fitted in said terminal engagement grooves.

7. The push-button switch of claim 6, wherein said switch cover further comprises two terminal insertion portions in which both the terminals of said light emitting element and end portions of said light emitting terminals are inserted.

8. The push-button switch of claim 4, wherein said first and second part each further comprise a rising connection portion elevated above the switch base, the rising connection portions of said first and second part being connected together to further unite the two parts.

* * * * *